US005625334A

United States Patent [19]

Compton

[11] Patent Number: 5,625,334

[45] Date of Patent: Apr. 29, 1997

[54] INDICATING DEVICE FOR WARNING A USER THAT A PRESCRIBED INTERVAL OF THE TIME AFTER EVENT HAS NOT ELAPSED

[76] Inventor: Karen A. Compton, 1619 Waters Edge La., Reston, Va. 22090

[21] Appl. No.: 375,366

[22] Filed: Jan. 19, 1995

Related U.S. Application Data

[63] Continuation-in-part of Ser. No. 84,148, Jul. 1, 1993, abandoned.

[51] Int. Cl.[6] ..... G08B 1/00

[52] U.S. Cl. ..... 340/309.15; 340/309.4; 340/545; 368/1; 368/10; 368/12; 368/327; 116/308; 221/3; 221/5; 221/15; 221/61

[58] Field of Search ..... 340/309.15, 309.4, 340/545; 368/327, 10, 12, 1; 116/308; 40/119, 121; 364/569; 221/3, 5, 15, 61

[56] References Cited

U.S. PATENT DOCUMENTS

| | | | |
|---|---|---|---|
| 3,993,452 | 11/1976 | Moulding | 422/102 |
| 4,223,801 | 9/1980 | Carlson | 221/3 |
| 4,258,354 | 3/1981 | Carmon et al. | 340/309.4 |
| 4,361,408 | 11/1982 | Wirtschafter | 368/10 |
| 4,367,955 | 1/1983 | Ballew | 368/10 |
| 4,382,688 | 5/1983 | Machamer | 368/10 |
| 4,419,016 | 12/1983 | Zoltan | 368/10 |
| 4,432,300 | 2/1984 | Lyss | 116/308 |
| 4,682,299 | 7/1987 | McIntosh et al. | 364/569 |
| 4,731,765 | 3/1988 | Cole et al. | 368/10 |
| 4,835,520 | 5/1989 | Aiello | 340/545 |
| 4,862,421 | 8/1989 | Drouin | 368/10 |
| 4,893,903 | 1/1990 | Thakar et al. | 350/334 |
| 4,912,687 | 3/1990 | Treeby | 368/10 |
| 4,918,673 | 4/1990 | Stabel | 368/10 |
| 4,939,705 | 7/1990 | Hamilton et al. | 368/10 |
| 5,058,088 | 10/1991 | Haas et al. | 368/327 |
| 5,170,380 | 12/1992 | Howard et al. | 368/10 |
| 5,313,439 | 5/1994 | Albeck | 368/10 |

FOREIGN PATENT DOCUMENTS

| | | | |
|---|---|---|---|
| 0385343 | 12/1932 | United Kingdom | 340/309.15 |
| 9309519 | 5/1993 | WIPO | 340/309.15 |

*Primary Examiner*—Jeffery Hofsass
*Assistant Examiner*—Benjamin C. Lee
*Attorney, Agent, or Firm*—Evenson, McKeown, Edwards & Lenahan P.L.L.C.

[57] ABSTRACT

The invention provides a device that cautions the user of medication, for example, by visual change and/or surface contour change of a part of a medicine container, that a preset time since an event, such as since the last prior use or application of the medication, has not transpired. The medicine container cover or an indicating element of the container or cover changes visually or dimensionally to signal the user that it is not advisable to administer the next dose of the medication. The device shuts itself down upon changing to a permissive configuration, and requires no power input until it is again activated by accessing the container.

17 Claims, 4 Drawing Sheets

INDICATING DEVICE FOR WARNING A USER THAT A PRESCRIBED INTERVAL OF THE TIME AFTER EVENT HAS NOT ELAPSED

BACKGROUND OF THE INVENTION

This application is a continuation in part of my previous application Ser. No. 08/084,148, filed Jul. 1, 1993, now abandoned.

This invention relates to devices for indicating that a particular event has occurred within a predetermined time interval. More specifically, the invention provides an indicator for use with medication containers that signals to the patient or user that a medication has already been taken within a particular time interval and should not be taken again.

It is well known that adherence to a prescribed medication schedule is extremely important. Most medications, whether professionally or self-administered, are prescribed with a particular dosage to be taken at certain time intervals, for example, weekly, daily, or several times throughout a day. However, because human nature is not as exact, deviations from the precise prescribed medication schedule frequently occur due to forgetfulness, or confusion with other prescribed medications being taken at the same time. In particular, a patent may take a certain medication, forget having taken it, and take another dosage shortly thereafter. Such a disruption in the medication schedule can hinder the effectiveness of the medication in the body. Even more serious, however, is the possibility that medication dosages taken too frequently can have an adverse reaction in the user due to the combined strength of the dosage.

Such problems with adhering to a medication schedule are frequently accentuated for elderly and infirm users, who are more likely to be taking several medications simultaneously which could cause confusion as to those dosages taken and when they were taken. Further, medication tolerance in the elderly and infirm is generally lower than for other individuals; thus medication taken out of sequence may have an enhanced reaction. Finally, such individuals frequently have vision problems which make it difficult for them to read output letters and/or numerals on time display devices, and may also encounter difficulty in making mental calculations necessary to determine from such readout information, how long it has been since a medication was last taken, or whether a particular medication has been taken as directed.

The above-described problems in obtaining patient compliance with prescribed medication schedules have been well documented and several attempts have been made to address the problems. For example, U.S. Pat. Nos. 5,313,439; 5,170,380; 4,939,705[(1)]; 4,862,431; 4,835,520; 4,682,299; 4,432,300; 4,419,016; 4,382,688; 4,361,408; 4,258,354; 4,223,801; and WO 93009519 all relate to various schemes to properly dispense medications. All but U.S. Pat. No. 4,939,705[(1)] produce audible and/or visual signals that actively demand a response or produce a lockout and therefore consume power continually. U.S. Pat. No. 4,939,705 is a variation on a device to preclude false indications. U.S. Pat. No. 4,432,300 reminds the patient to take the next dose of medication through his actively manipulating the cap at each application, and requires an awareness of day, date and/or time on the part of the patient.

In U.S. Pat. No. 4,419,016, a medicine container includes a time keeping device displaying the time and day of the week when the container was last opened by the patient. A visual or audible alert signals the patient when the next dosage is to be taken. However, the device requires that the user calculate the elapsed time since the medication was last taken, based on the time displayed on the container. Such a time display does not easily and simply allow the user to ascertain whether he has taken the medication within a particular time period, or whether he can take another dose of the medication.

Likewise, U.S. Pat. No. 4,382,688 provides a timer and dispenser for medication especially adapted for use with birth control pills that are taken on a daily basis. A circuit provides for activation of an alarm signal at preset time intervals in order to remind the user to take the medication. However, the apparatus does not solve the problem as to how to warn or prevent a patient from taking medication too frequently.

SUMMARY OF THE INVENTION

The present invention overcomes the problems associated with the prior art by providing an indicator device for warning the user not to take another dosage of medication prior to the expiration of a prescribed time interval. It requires no special programming other than one-time setting a minimum time duration, and it shuts itself down, continuing to display permission to ingest the next dosage of medication, consuming no power until someone again accesses the container, thus reinstating the cycle.

An advantage of the present invention is that it provides a simple and easily understandable signal to the patient indicating when it is advisable or inadvisable to take another dose of medication. The device makes use of a simple signal indicator, such as a color, shade, or symbol change, that is readily understandable by the user. This type of indication can be provided on a surface of the medicine container; it is easily made part of the medicine container cap or lid.

Another advantage of the present invention is that, for example, while the prior art is inflexible with its alarms, lights or buzzers, with the medication dispenser according to the invention, a medication administered, for example, at 12-hour intervals could be set to be permissible after 10 hours or 11 hours, thus giving reasonable tolerance in the exact time of ingestion. This greatly simplifies efforts to adhere to a medication schedule as the user need only glance at the medicine container to ascertain whether he may or may not take another dose. The invention is especially useful in view of the repetitive nature with which medications are taken, thus easily confusing the patient with regard to whether he absent-mindedly took the medication within a recent time.

Yet another advantage of the present invention is that a relatively inexpensive mechanism for implementing the indicator can be provided. Thus, the device can be placed on a medication container by the container manufacturer or the pharmacy prior to its receipt by the patient. This helps eliminate patient error that invariably occurs with attempts to get the patient to comply with a medication schedule. Rather, using the present invention, control of the indicator device can be left in the hands of the manufacturer and pharmacist who are especially well trained to ensure the device is used properly with each medication prescribed.

It is yet another advantage of the present invention that, since it shuts itself down between container operation events, the device can be set and applied to a medication and then left on the shelf for a prolonged period. Hence, the device begins operation only after the medicine container is again accessed. This conserves the device's power supply and confines its use to the time duration of the medication prescription. Such a unique mechanism allows the present invention to be used by manufacturers and pharmacists without having to worry about depletion of the indicator power supply when the unit is stored.

Still a further advantage of the present invention is that the indicator mechanism requires the use of the power supply only during the time intervals between the user's taking the medication. In this manner, depending upon the duration of the prescription and the time interval between dosage, a relatively small amount of energy is required for the duration of the prescription. Therefore, the reliability of the device is considerably improved relative to the prior art.

Still yet a further advantage of the present invention is that the indicator device can have a highly beneficial impact as a cross check in hospitals or nursing homes for example. The device offers an independent check for comparison to a patient's chart or medication log by indicating when a medication may again be administered to a patient. Devices with flashing lights and buzzers are not as suitable to applications in hospitals or nursing homes.

Other objects, advantages and novel features of the present invention will become apparent from the following detailed description of the invention when considered in conjunction with the accompanying drawings.

DETAILED DESCRIPTION OF THE DRAWINGS

Figure 1A:
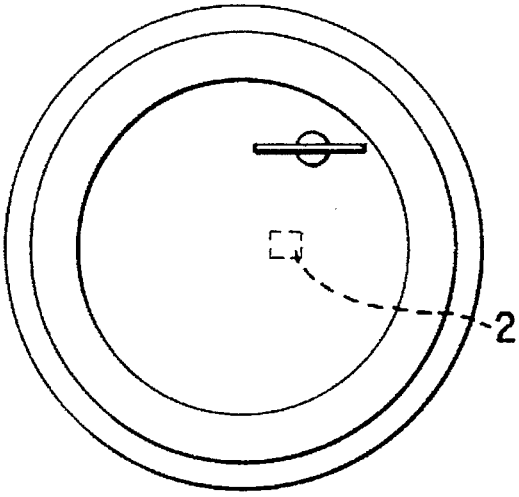
FIG. 1A is a top view of a medication container embodying the warning device according to the present invention.
Figure 1B:
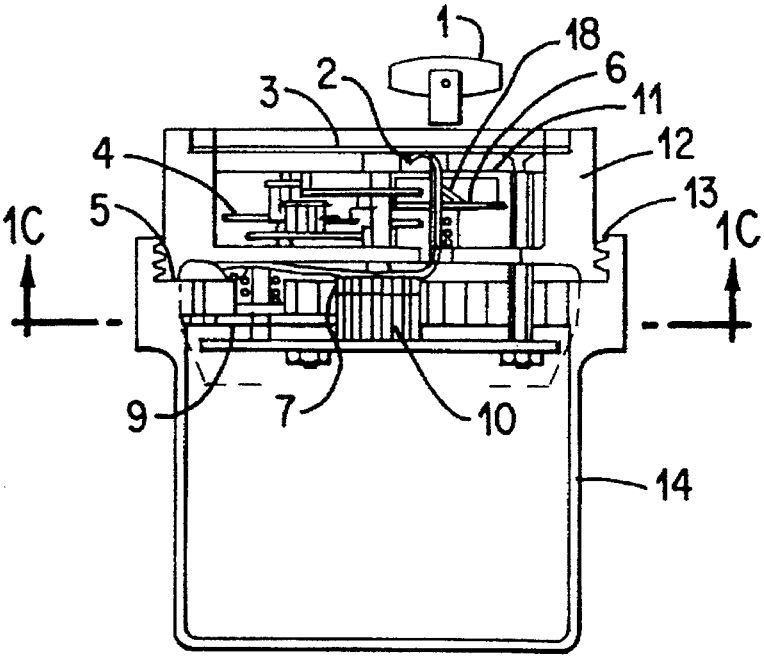
FIG. 1B is a partial cross sectional view of a medication container embodying the warning device according to the invention.
Figure 1C:
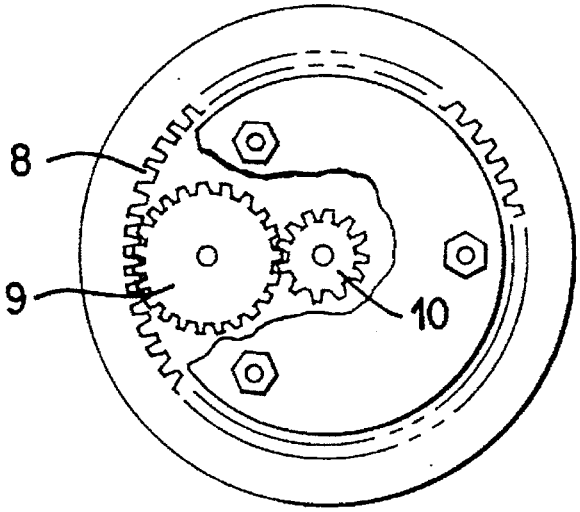
FIG. 1C shows a cross section of the container of FIG. 1A, viewed along line 1C—1C.

FIGS. 1A–1C illustrate the mechanical embodiment, which has a translucent film 3, shown in a relaxed, permissive configuration, as described in more detail below. The medicine bottle 14, is closed by the cap assembly 12, which contains all of the movable components of the device. When the cap assembly is installed on the bottle, setting gear 9 engages ring gear 8 which is built into the bottle. As the cap assembly is tightened into place, the number of revolutions made by the cap assembly prior to its seating on surface 5 determines the set time of the clock in the same manner as turning the setting hand on the well-known spring wound alarm clock. Longer or shorter set times can be provided by adjusting the length of the female thread 13 in the bottle; thus, various set times can be controlled by the dispensing pharmacist according to the length of the thread on the bottle in which the medication is dispensed, or by affixing a shim on surface 5.

A conventional mechanical clock escapement mechanism 6 in the cap assembly controls the speed of rotation of gear train 4 (the clock) which drives gear 7. Gears 7 and 10 have ratcheting ramps molded in them. Gear 7 is free to translate along its axis restrained by the spring arm 2 on the one side and by matching gear 10 on the other side. (See FIG. 2.)

Setting gear 9 determines the relative positions of the interfacing ramps on gears 7 and 10, and thus determines how long the gear train in the cap assembly will run before the ramps align and spring bar 2 snaps into its relaxed position (shown). When spring bar 2 moves to the relaxed position, it allows the membrane 3 to relax to a flat position and at the same time, lever 18 impinges upon the escapement wheel, stopping the clock. In this manner, the translucent film 3 stays in its relaxed, flat position, allowing a graphic on base 11 to be seen through the translucent film.

Figure 2A:
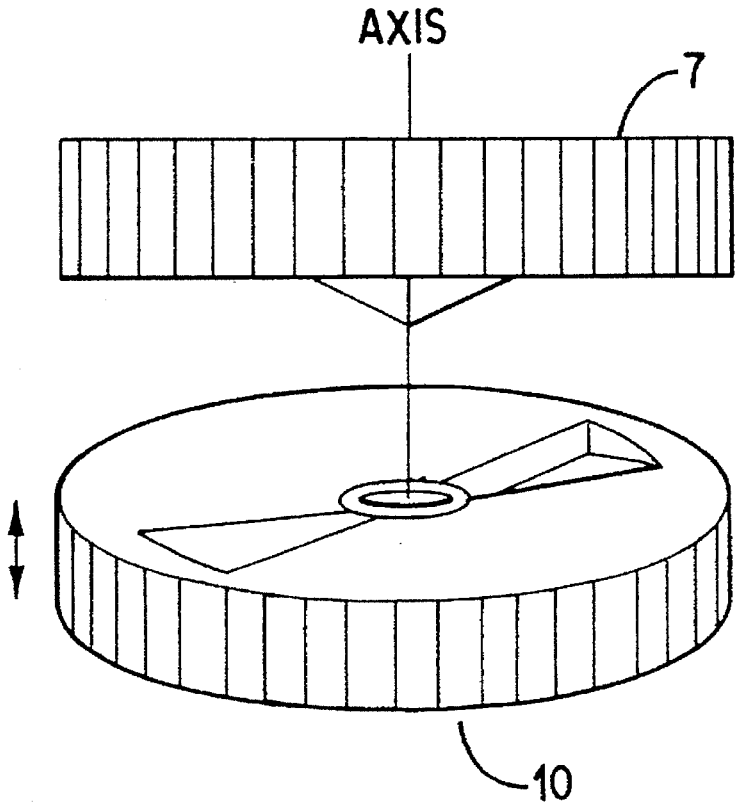
FIG. 2A is a perspective view of gear elements 7 and 10 in FIG. 1B.
Figure 2B:
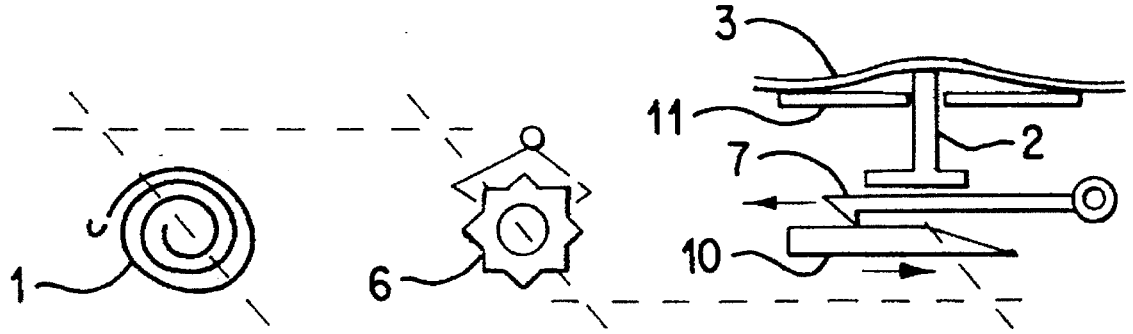
FIG. 2B illustrates the principle of operation of the mechanical embodiment of the invention.

FIG. 2B illustrates schematically the operating principle of the invention, while FIG. 2A shows a detail of the interfacing, ratcheting ramps of gear 7 and 10.

Figure 3A:
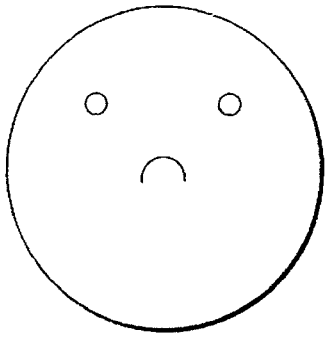
FIGS. 3A and 3B show a graphic warning symbol and authorization symbol, respectively.
Figure 3B:
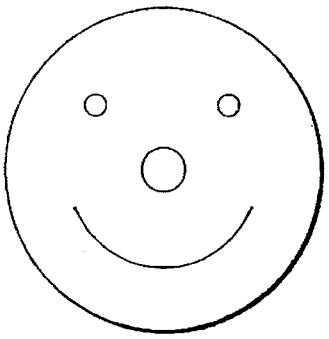

FIGS. 3A and 3B illustrate one design of a cap with the film in a caution (up) position; FIG. 3B shows a permissive (relaxed) film position, in which the graphic printed on the base 11 shows through the translucent film, creating a smiling face symbol. Other indications, colors, or shades could also be employed to impart the permission/denial message.

ELECTRONIC EMBODIMENT

Figure 4:
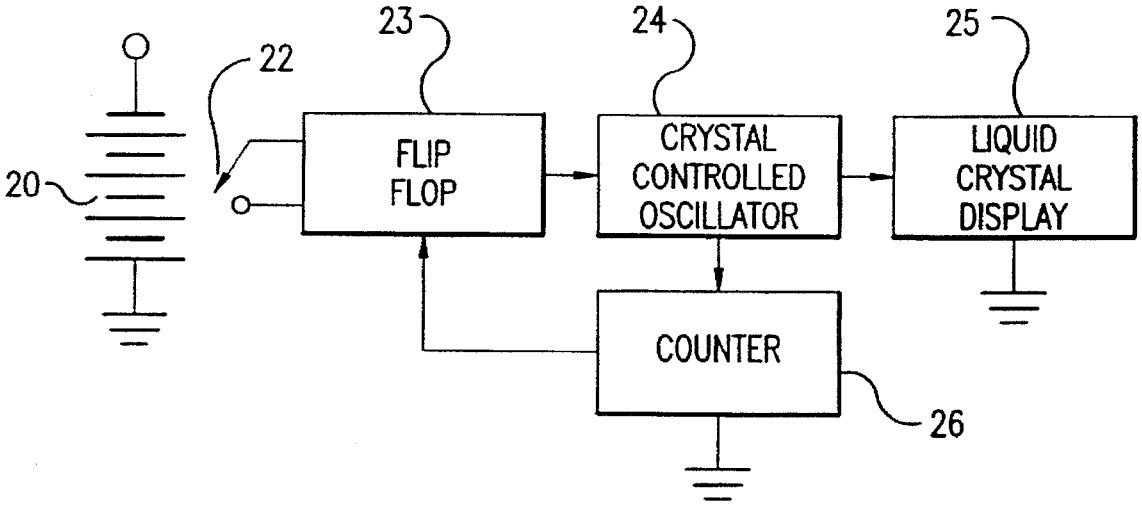
FIG. 4 is a block diagram of an electronic embodiment of the invention.
Figure 5A:
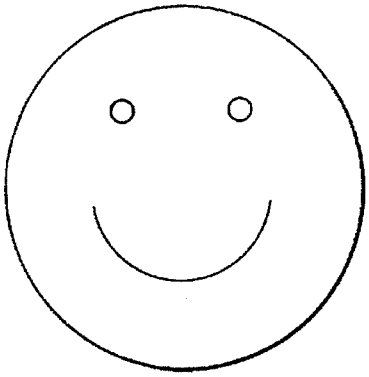
FIG. 5 is another embodiment of graphic display symbols according to the invention.
Figure 5B:
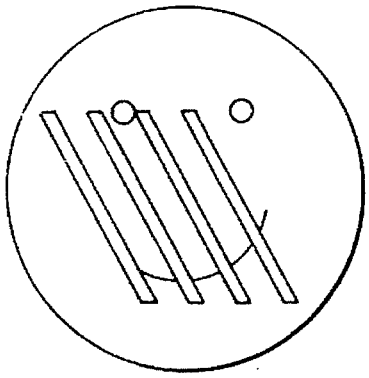

An equivalent mechanism can be incorporated into an electronic circuit "chip". On the top surface of the medicine bottle cap, a liquid crystal display covers a permissive indicator; e.g., a smiling face caricature (FIGS. 5A, 5B). When the bottle cap is opened and closed, the liquid crystal is energized, and it creates lines over the permissive, smiling face graphic (FIG. 5B). A block diagram of the circuit is illustrated in FIG. 4. FIG. 5A shows the bottle with its cap in the permissive mode; FIG. 5B depicts a typical bottle cap that has been opened and closed recently, and therefore is within its "caution" time. Again, color or shades may be substituted for the smiling face symbol.

Referring to FIG. 4, the bottle cap contains the battery powered electronic timing circuit that can be preset by the drug manufacturer or pharmacist. When the container lid is closed, the normally open switch 22 is closed, sending power to the flip flop, which provides an output signal to a crystal controlled oscillator 24, which in turn provides outputs to a liquid crystal display 25 as well as to a counter 26. The counter 26 is coupled to the flip flop 23.

As indicated above, the liquid crystal display 25 generates dark line(s) that obscure the permissive indicator. FIG. 5A illustrates a graphic under the liquid crystal. FIG. 5B is a representation of an energized liquid crystal display, obscuring the permissive graphic.

Figure 6:
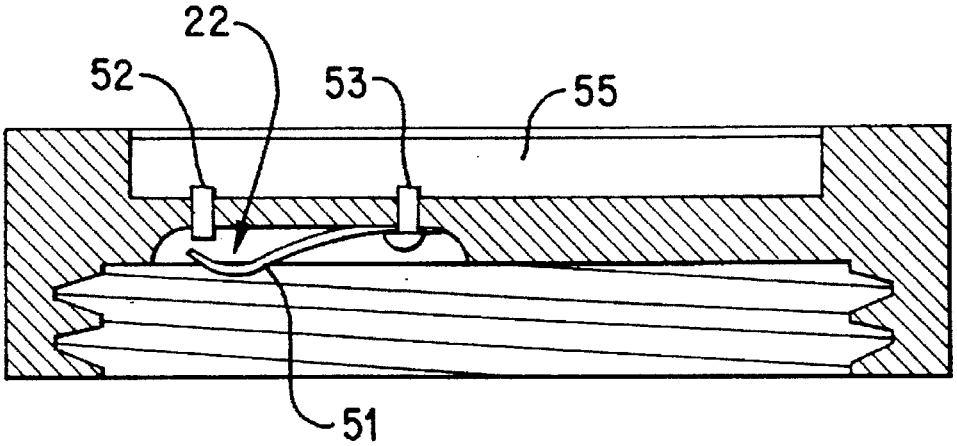
FIG. 6 is a cross sectional view of a container cap suitable for use with the embodiment of FIG. 4.

FIG. 6 is an illustration of a normally open switch (22 in FIG. 4) showing one method for making contact between conductors 52 and 53. When the non-conductive cap is screwed or snapped onto the medicine bottle, the conductive spring 51 engages the lip of the bottle, and is forced to engage conductor 52, thus completing the circuit and starting the counter.

In operation, again referring to FIG. 4, when the cap of the medicine container is installed, the "cap closed" contacts 22 couple the power supply 20 to the flip flop 23. The flip flop 23 changes state and provides a triggering signal that activates the crystal controlled oscillator 24. Similarly, the crystal controlled oscillator 24 provides an output signal for driving the liquid crystal display 25. This cautions the patient not to take another dose of medicine. The liquid crystal display 25 continues to operate until a predetermined time interval (determined by counter 26) has expired, which may be the prescribed time between dosages or a lesser period. When the counter 26 runs down a preset time, it signals the flip flop 23 to change state; i.e., turn off. This disconnects the power supply 20 from the flip flop 23. The crystal controlled oscillator 26 and liquid crystal display 25 are therefore de-energized. The system thus remains at rest until the "cap closed" contacts 22 again powers the circuit to restart the counter 26. In this manner, the power supply 20 is not used except for the duration of the time interval between dosages.

While a simple electrical circuit has been illustrated in FIG. 4, it is readily understood by those skilled in the art that any number of electrical circuits could be designed to perform the same function without departing from the scope of the invention.

The invention provides a simple and readily understood signal to the patient when not to take another dose of medicine. The invention does not require the patient to calculate elapsed times based on a standard time display. Rather, by simply observing or touching the medicine container, the user can tell whether a prescribed time has passed since the container was last opened.

In view of the simplicity of the present invention, the device can be applied directly to a medicine container by the manufacturer of the medicine. Since the indicator device remains dormant until the cap is opened, the container can sit idly on a retail shelf for a prolonged period without deterioration of the indicating device power supply except due to aging of the battery.

The electrical circuit shown in FIG. 4 can be mass produced with different counters having various durations corresponding to typical drug usage intervals, i.e., three times a day, four times a day, five times a day, etc. or it may be set by operating a normally open single-pole switch. Either method would eliminate the sometimes tedious programming necessary with prior art devices. Instead, the pharmacist or drug manufacturer may simply select the proper circuit (or cap) already having the circuit installed that suits the particular prescription.

The lines shown obscuring the permission indicator in FIG. 5B may be the elements of a standard two-digit liquid crystal display. The lines can become any number from one to 99 to be used in the counter setting procedure.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Medication container apparatus comprising:

a container for medication which is to be dispensed therefrom and ingested no more frequently than once per predetermined time period;

an access mechanism for opening and closing said container to dispense medication thereof;

a sensor to detect closing of said access mechanism; and an electrically actuated visual display apparatus, activated when said sensor detects closing of said access mechanism and deactivated upon expiration of a time period corresponding to said predetermined time period thereafter, for displaying during said predetermined time period, a visible caution signal indicating that said access mechanism has been operated within said preceding time period corresponding to said predetermined time period, whereby a consumer of said medication is informed not to ingest said medication during said predetermined time period.

2. Container apparatus according to claim 1 wherein said access mechanism is a container cap.

3. Container apparatus according to claim 2 wherein said display apparatus comprises a movable translucent film arranged over a consent indicator symbol, whereby actuation of said display apparatus separates said translucent film from said symbol, and obscures said consent indicator symbol.

4. Container apparatus according to claim 2 wherein said display apparatus comprises a liquid crystal arranged over a consent indicator symbol, whereby actuation of said display apparatus obscures said consent indicator symbol.

5. Container apparatus according to claim 4 wherein said display apparatus is actuated in response to operating said container cap.

6. Medication container apparatus comprising:

a container for medication which is to be taken no more frequently than once per predetermined time period;

an openable closure member for said container;

a mechanism that detects closing of said closure member;

an electrically actuated visible caution indicator for informing a consumer of said medication not to ingest said medication;

means operative upon closing of said closure member, for activating said visible caution indicator; and means for terminating activation of said visible caution indicator at a predetermined time after said closing.

7. Closure apparatus for a medication container comprising:

a closure member which can be opened to permit access to medication in a container, which medication is to be dispensed from said container and ingested no more frequently than once per predetermined time period;

means for detecting closing of said closure member;

an electrically actuated visible caution display unit for informing a consumer of said medication not to ingest said medication;

means operative upon closing of said closure member, for activating said visible caution display unit; and means for terminating said visible caution display at a predetermined time after said closing of said closure unit.

8. A method for operating a medicine container having a closure member operable to permit access to contents of said container, said method comprising the steps of:

detecting operation of said closure member;

in response to detecting said operation of said closure member, applying electric power to actuate an electrically driven visual caution indicator for informing a consumer of said medication not to ingest said medication; and terminating application of electric power said visual caution indicator upon expiration of a predetermined time period after operation of said closure member, whereby said consumer is warned not to ingest said medication during said predetermined time period.

9. A method according to claim 8 wherein said predetermined time is the end of a fixed time period measured from closing of said container.

10. A cap for medicine container having a display for informing a consumer of medicine in said container when it is not advisable to ingest said medicine, said cap comprising:

a threaded portion for engaging with threads built into said container, when said cap is fitted on said container;

a mechanical timer;

gear means for winding and then activating said mechanical timer to operate for a period of time in response to engagement and rotation of said threaded portion with said threads on said container during tightening of said cap to said container;

a display unit having a visible warning signal, said display unit being actuated to display said visible warning signal only when said mechanical timer is operating.

11. Cap according to claim 10, wherein said display unit comprises:

a flexible translucent film arranged on said warning signal; and a mechanical member actuated by said timer to deform said translucent film into a warped contour wherein at least a portion of said translucent film is separated from the warning signal, and wherein said warped contour has a bump which can be detected tactilely.

12. Cap according to claim 10, wherein said display unit further comprises a tactilely detectable warning signal.

13. Cap according to claim 10 wherein said gear means comprises a setting gear adapted to engage with a stationary ring gear when said cap is placed onto an opening of said container.

14. Cap according to claim 13 wherein said ring gear is coupled to rotate said setting gear in response to rotation of said threaded portion of said cap relative to said threads on said container.

15. Cap according to claim 14 wherein length of said period of time is determined by an extent of rotation of said threaded portion of said cap relative to said threads on said container.

16. Cap according to claim 15 wherein said display unit comprises:

a graphic warning symbol;

a flexible translucent film arranged in juxtaposition to said warning symbol, so that said warning symbol is visible therethrough;

a spring bar actuated by said timer for deforming said translucent film into a warped contour wherein at least a portion thereof is separated from said graphic warning symbol while said timer is operating, whereby said warning symbol is not visible through said translucent film.

17. Cap according to claim 16 wherein said warped contour of said translucent film has at least a bump which can be detected tactilely.

* * * * *